United States Patent [19]

Yang

[11] Patent Number: 4,866,865

[45] Date of Patent: Sep. 19, 1989

[54] NAMECARD HOLDER

[76] Inventor: Ren G. Yang, Rm. 1104, No. 102, Nanking E. Rd., Sec. 5, Taipei, Taiwan

[21] Appl. No.: 153,074

[22] Filed: Feb. 8, 1988

[51] Int. Cl.[4] ..... G09F 27/00

[52] U.S. Cl. ..... 40/455; 40/1.5

[58] Field of Search ..... 40/455, 457, 124.1, 40/1.5, 1.6, 902, 906; 446/175, 396; 272/14; 434/308, 309, 311; 369/68, 273

[56] References Cited

U.S. PATENT DOCUMENTS

| | | | |
|---|---|---|---|
| 3,803,728 | 4/1974 | Scott | 40/457 |
| 4,286,399 | 9/1981 | Funahashi et al. | 40/124.1 |
| 4,531,310 | 7/1985 | Acson et al. | 40/1.5 |

*Primary Examiner*—Robert P. Swiatek
*Assistant Examiner*—Cary E. Stone
*Attorney, Agent, or Firm*—Morton J. Rosenberg

[57] ABSTRACT

This invention relates to a namecard holder and in particular to one including an electrical circuit and a control switch disposed at one side of a notch of an open end thereof. The control switch has a conducting plate and a curved spring leaf which are normally in contact with each other. The spring leaf is provided with a lower end for preventing namecards from leaving the holder unintentionally. When a namecard is partially drawn out of the holder, the conducting plate will be separated from the spring leaf thereby activating the electrical circuit and as the namecard is completely drawn out of the holder, the conducting plate will contact the spring leaf again consequently actuating a musical or speech IC and a pressure electrical vocal producer to send out music or speech to appeal the visitor's attention.

1 Claim, 4 Drawing Sheets

NAMECARD HOLDER

BACKGROUND OF THE INVENTION

It is found that the namecard holder on the market is only designed to receive namecard and has no other functions.

Therefore, it is an object of the present invention to provide an improved namecard holder which will send out music to appeal to the attention of the visitor when a namecard is drawn out therefrom so as to enhance the impression made by the owner.

SUMMARY OF THE INVENTION

This invention relates to a namecard holder.

It is the primary object of the present invention to provide a namecard holder which can produce music or speech to appealingly attract attention.

It is another object of the present invention to provide a namecard holder which is simple in construction.

It is still another object of the present invention to provide a namecard holder which is easy to manufacture.

It is still another object of the present invention to provide a namecard holder which is inexpensive to fabricate.

It is a further object of the present invention to provide a namecard holder which is practical in use.

Further objects, features and advantages of the present invention will be more fully appreciated by reference to the following detailed description of a presently preferred, but nonetheless illustrative embodiment in accordance with the accompanying drawings, wherein:

DETAILED DESCRIPTION OF THE PREFERRED EMBODIMENT

The novel features which are characteristics of the invention, together with further objects and advantages thereof will be better understood form the following description considered in connection with the accompanied drawings in which a preferred embodiment of the invention is illustrated by way of example. It is to be expressly understood, however, that the drawings are for the purpose of illustration and description only and are not intended as a definition of the limits of the invention.

Figure 1:
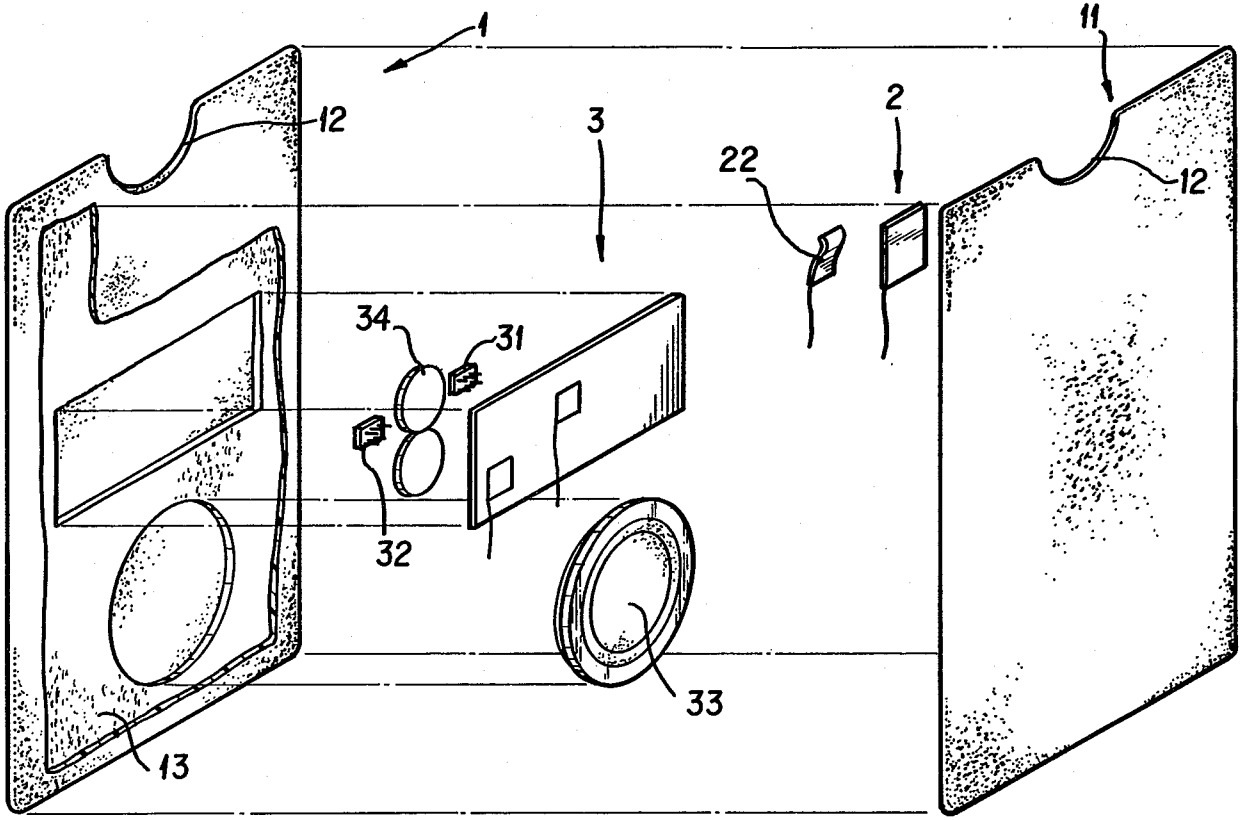
FIG. 1 is an exploded view of a namecard holder according to the present invention.
Figure 2:
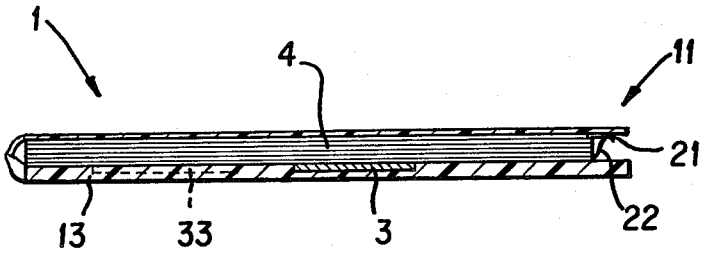
FIG. 2 is a sectional view of the present invention.

Referring now to the drawings and in particular to FIG. 1 thereof, the namecard holder according to the present invention mainly comprises a body 1 having an open end 11 at which there are a conducting plate 21 and a spring leaf 22 of a control switch 2. Disposed within a recess 13 of the body 1 is an electrical means 3 which includes an electrical circuit 31, a musical or speech IC 32, a pressure electrical vocal producer 33 and a power supply 34. When a namecard 4 is received in the holder 1, the conducting plate 21 at the open end 11 will be in contact with the spring leaf 22 (see FIG. 2).

Figure 3:
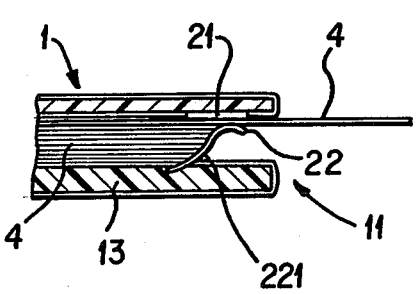
FIG. 3 shows the action to draw a namecard from the present invention.
Figure 4:
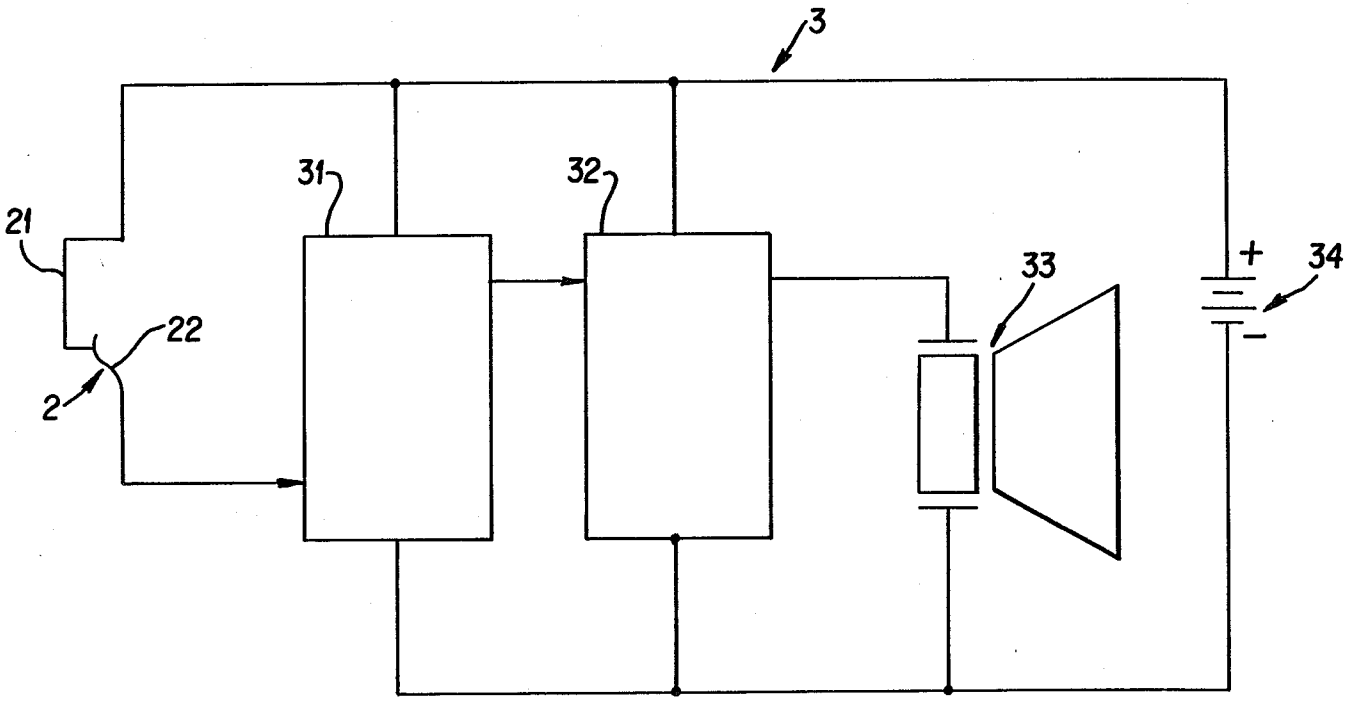
FIG. 4 is a circuit of the electrical means of the present invention.
Figure 5:
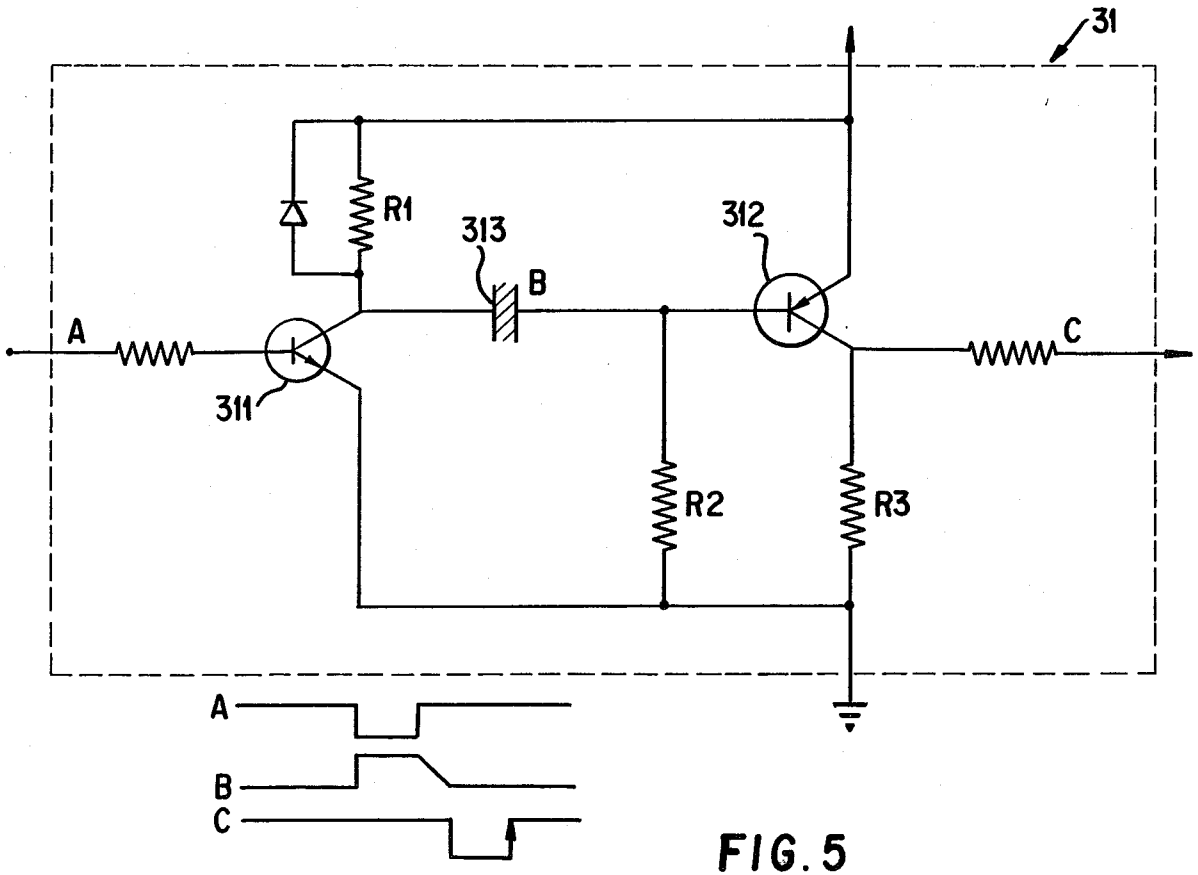
FIG. 5 is a controlling circuit of the present invention.

The spring leaf 22 has a curved portion 221 for preventing the namecard 4 from withdrawing unintentionally. When desired to draw a namecard 4 from a notch 12 of the holder 1, only a namecard at the tip can be drawn out (as shown in FIG. 3). When the conducting plate 22 is separated from the spring leaf 22 by the namecard 4, the electrical circuit 31 will be actuated (as shown in FIG. 4). The electrical circuit comprises a NPN transistor 311 and a PNP transistor 312 between which there is a capacitor 313 (see FIG. 5). The procedure is shown as below circuit voltage wave shape. Let the NPN transistor 311 be terminal A, the capacitor 313 be termianl B, and the PNP transistor 312 be terminal C. Before the namecard 4 is drawn out, A and C are at high potential (positive) while B is at low potential. When the namecard 4 is drawn out, the present circuit will begin to work. Then, A is dropped down to low potential, B is charged and at high potential and C is still at high potential. As the namecard 4 is drawn out from the holder 1, the conducting plate 21 for controlling the switch 2 will contact the spring leaf 22 again and A will return to high potential, B will gradually drop down to low potential and C will drop down to low potential too. When it goes back to high potential, the musical or speech IC 32 will be actuated to send out music or speech via the pressure electrical vocal producer 33 thereby appealing to the visitor and therefore, increasing the impression. The IC 32 will stop after the predetermined period for sending out music has past. However, the IC 32 will be actuated again when the next namecard 4 is drawn out from the holder 1.

It is obvious that minor changes may be made in the form and construction of the invention without departing form the material.

Obviously, many modifications and variations of the present invention are possible in the light of the above teachings. It is therefore to be understood that within the scope of the appended claims, the invention may be practiced otherwise than as specifically described.

I claim:

1. A namecard holder formed by a body member having an open end, said open end having a notch formed therein for removing one of a plurality of namecards stored therein, comprising:

a control switch disposed in a portion of a recess formed within said body member adjacent said notch at said open end, said control switch including a conducting plate in conductive contact with a spring leaf having a curved contour, said spring leaf having a lower end for preventing said plurality of namecards from leaving the namecard holder unintentionally;

electrical means electrically coupled to said control switch for generating control signals responsive to said control switch, said electrical means including a power source coupled to a transistor switching circuit disposed within said recess for generating a first of said control signals responsive to separation of said spring leaf from said conducting plate, said separation being responsive to a partial withdrawal from said body member of one of said plurality of namecards, said transistor switching circuit generating a second of said control signals responsive to said spring leaf returning to conductive contact with said conducting plate, said return of conductive contact being responsive to said namecard being fully withdrawn from said body member; and, means for audio generation coupled to said transistor switching circuit, said means for audio generation including (1) a music or speech integrated circuit disposed within said recess for generating an audio electrical signal of predetermined duration responsive to receipt of said second control signal subsequent to said first control signal, and (2) a pressure electrical vocal producer disposed within said recess and coupled to said integrated circuit for transducing said audio electrical signal to a sonic signal output.

* * * * *